US005408850A

United States Patent [19]

Kawase et al.

[11] Patent Number: 5,408,850

[45] Date of Patent: Apr. 25, 1995

[54] FIBER WASTE COLLECTOR/REMOVER AND COOLING APPARATUS FOR USE WITH A CIRCULAR KNITTING MACHINE

[75] Inventors: Shinji Kawase; Toshiro Izumi, both of Hyogo, Japan

[73] Assignee: Precision Fukuhara Works, Ltd., Japan

[21] Appl. No.: 189,572

[22] Filed: Jan. 31, 1994

[30] Foreign Application Priority Data

Feb. 2, 1993 [JP] Japan ..... 5-039472
Apr. 13, 1993 [JP] Japan ..... 5-111021

[51] Int. Cl.[6] ..... D04B 35/32; D04B 15/14
[52] U.S. Cl. ..... 66/168; 66/8
[58] Field of Search ..... 66/8, 168; 15/300.1, 15/301

[56] References Cited

U.S. PATENT DOCUMENTS 2,648,209 8/1953 Reinhartdt et al. ..... 66/168
3,167,940 2/1965 Limbacher et al. ..... 66/151
3,678,713 7/1972 Woodford ..... 66/168 X
4,703,632 11/1987 Izumi et al. ..... 66/168
5,177,985 1/1993 Igarashi et al. ..... 66/168

FOREIGN PATENT DOCUMENTS 485258 10/1991 European Pat. Off. ..... 66/168
510508 10/1992 European Pat. Off. ..... 66/168
531919 3/1993 European Pat. Off. ..... 66/168
1018067 1/1966 United Kingdom ..... 66/168
1207682 10/1970 United Kingdom .
2091302 7/1982 United Kingdom .

*Primary Examiner*—John J. Calvert
*Attorney, Agent, or Firm*—Bell, Seltzer, Park & Gibson

[57] ABSTRACT

Fiber waste generated during operation of a circular knitting machine is removed from components of the machine by an air suction/blowing fan motor which causes air currents that conduct the fiber waste to one or more filters. Air suction removes the fiber waste from the filters. An adjustable suction cylinder cooperates with the air suction/blowing fan motor to draw air from below the knitting cylinder through a cooling orifice to simultaneously cool the knitting unit.

13 Claims, 6 Drawing Sheets

FIBER WASTE COLLECTOR/REMOVER AND COOLING APPARATUS FOR USE WITH A CIRCULAR KNITTING MACHINE

FIELD OF INVENTION

The present invention relates to knitting machines, and, more particularly, to an apparatus for collecting and removing fiber waste from a circular knitting machine while cooling the knitting unit thereof.

BACKGROUND OF INVENTION

Conventional knitting units of circular knitting machines are traditionally associated with more than 100 yarn supply bobbins. When certain yarns are employed for forming the knitted fabric, dust, lint and waste fibers (collectively referred to hereinafter as "fiber waste") are generated by engagement of the yarns with the machine's yarn feeding, guiding and/or other components of the knitting machine and creel. The amount of fiber waste set adrift in the ambient air is substantial. This amount of fiber waste tends to increase as the operating speed of the knitting machine increases. Once the fiber waste has become airborne, it tends to settle upon the yarn feeders, yarn guides and the knitting unit of the knitting machine, and even upon adjoining machines.

This fiber waste occasionally gets knitted into the fabric causing defects in the fabric and in some cases, damage to the needles and other components of the knitting unit. This accumulation of fiber waste necessitates frequent overalls of the knitting units on the machine which is both costly and time consuming.

Various kinds of devices have heretofore been proposed for removing fiber waste generated by the knitting unit. The majority of the prior devices employ either a motor driven fan or an air blower to blow the fiber waste away. It has also been proposed to provide a cover about each knitting machine, and to install an exhaust duct near the machine so that the machine operator may gather the fiber waste and introduce it into an exhaust duct. The large installation costs associated with such a method make it less desirable. In addition, this method requires shielding the machine body which negatively affects access to the machine and the surrounding work environment. Moreover, once lubricants, such as oil, etc., stick on the shielding member, fibers tend to adhere to the shielding member which is both unsightly and unsanitary.

As disclosed in U.S. Pat. No. 5,177,985, the assignee of the present invention has previously developed a system for the collection and removal of fiber waste which utilizes a fixed suction cylinder which cooperates with the suction/blowing means to direct fiber waste laden air from the knitting unit into a filter means. While this system constitutes a marked improvement in fiber waste removal and collection from circular knitting machines, the system does have limitations due to the fixed character of the suction cylinder.

As the operational speed of the knitting machines increases, the elements of the knitting unit begin to overheat, causing heat expansion which results in distortion of the cylinder and its surrounding components. This distortion in turn causes degradation in the accuracy of the knitting machine. However, such distorting and degradation could be prevented if the knitting machine was cooled during operation. Heretofore, no effective cooling of the knitting unit during operation has been made available.

SUMMARY OF THE INVENTION

In view of the foregoing background, it is an object of the present invention to provide an apparatus for use with a circular knitting machine which collects and removes fiber waste while also cooling the knitting unit thereof.

These and other objects, features and advantages of the present invention are provided by an apparatus for cooling a knitting unit of a circular knitting machine and collecting and removing fiber waste generated by the circular knitting machine in making knit fabric. The apparatus includes an air suction/blowing means located above the knitting unit of the circular knitting machine for generating air currents through the knitting unit and across the other elements of the knitting machine to remove fiber waste therefrom and entrain the same therein. A filter is provided above the air suction/blowing means for collecting fiber entrained in air currents blown thereto. An adjustable suction cylinder is located between the needle cylinder and the air suction/blowing means and assists the air suction/blowing means in creating a vacuum therein for drawing air upward through the knitting unit and for drawing air into the filter. Because the suction cylinder is adjustable relative to the air suction/blowing means and the knitting unit, the amount of air flow through the knitting unit may be increased or decreased.

To cool the knitting unit while fiber waste is removed therefrom, a cooling orifice is created between the inside of the needle cylinder of the knitting machine and the knit fabric being produced. This orifice is created by an orifice disk which controls and positions the knit fabric inside the needle cylinder in such a manner that the air currents are directed or channeled to and across the knitting unit.

It is preferable that the cooling orifice be a channel having a cross section which decreases as it approaches the knitting unit which causes air to speed up as it passes therethrough to cool the knitting unit. Increasing the air speed passing through the cooling orifice improves the cooling effect of the air.

BRIEF DESCRIPTION OF THE DRAWINGS

Some of the objects, features and advantages of the present invention having been stated, others will become apparent as the description proceeds, when taken in conjunction with the accompanying drawings in which.

DESCRIPTION OF THE PREFERRED EMBODIMENTS

The present invention will now be described more fully hereinafter with reference to the accompanying drawings, in which a preferred embodiment of the invention is shown. This invention may, however, be embodied in many different forms and should not be construed as limited to the embodiment set forth herein. Rather, the illustrated embodiment is provided so that this disclosure will be thorough and complete, and will fully convey the scope of the invention to those skilled in the art to which it relates. Like numbers refer to like elements throughout.

Figure 1:
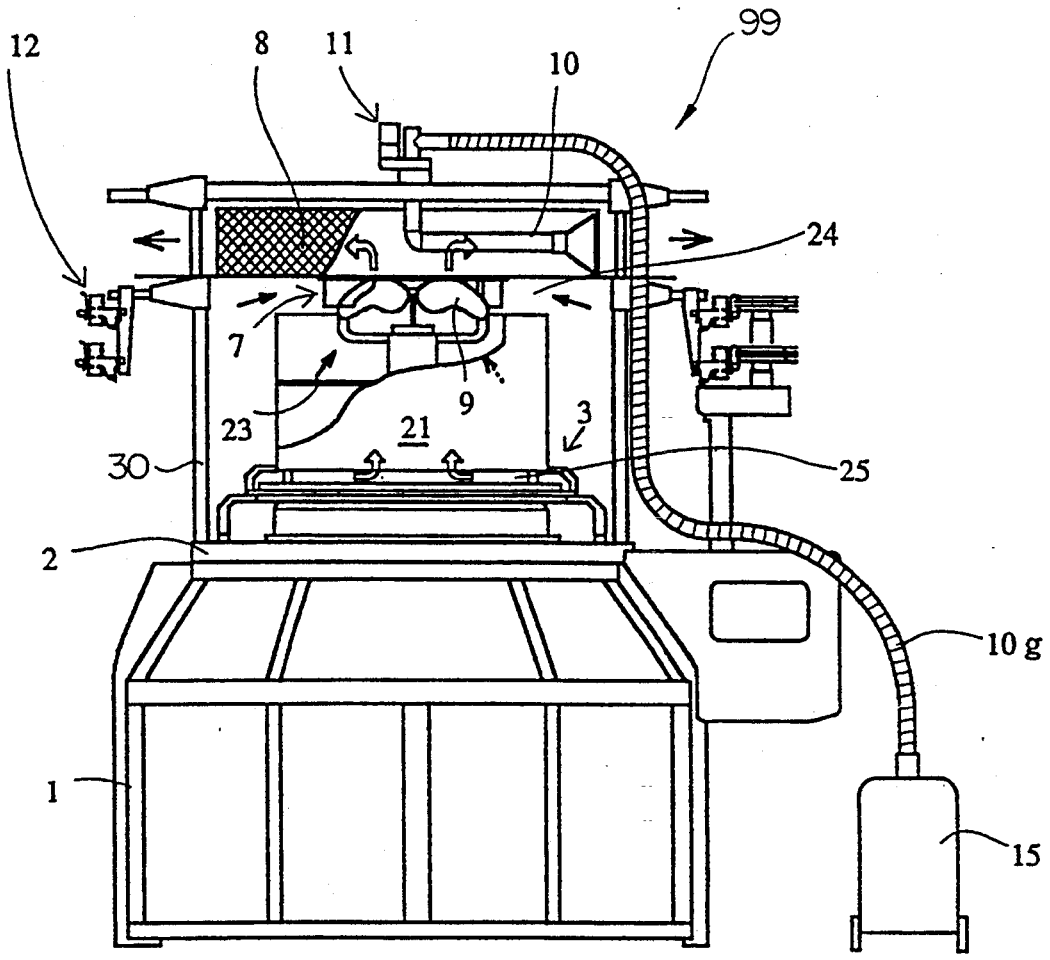
FIG. 1 is a front elevational view of a circular knitting machine having a fiber waste collector, remover and cooling apparatus in accordance with a first embodiment of the invention.
Figure 2:
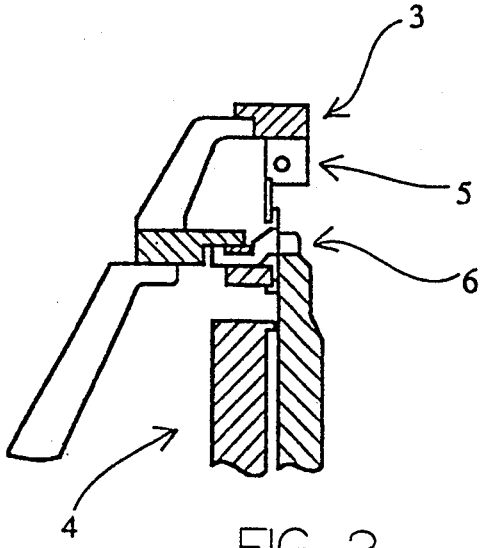
FIG. 2 is an enlarged sectional view of a portion of the knitting unit shown in FIG. 1.

A circular knitting machine 99 as shown in FIGS. 1 through 4, has a plurality of legs 1 supporting a bed or frame 2 that in turn supports a circular knitting unit 3. The knitting unit 3 as shown in FIGS. 1 and 2, includes a needle cylinder 4 rotatably supported on the frame 2, yarn feeders 5 and sinkers 6.

Located above the knitting unit 3, is a fiber waste collector/remover 7 for collecting and removing fiber waste generated during operation of circular knitting machine 99. As shown best in FIG. 3, the fiber waste collector/remover 7 includes an annular filter 8, a suction/blowing means 9, preferably a motor driven fan 9, and a filter cleaner 10. Rotative movement is imparted to either the filter cleaner 10 or the filter 8, so that they may rotate relative to each other, by a drive motor 11.

The filter 8 may be divided into two or more vertical sections, which are joined together in a conventional manner to create an integral unit. The filter 8 includes a first surface **8*a* and an opposite second surface 8*b* such that fiber waste may be collected on either surface 8*a* or 8*b*. In the embodiments shown, waste fibers are collected on first surface 8*a*. The filter 8 has a large number of perforations which are preferably between 20–40 meshes per inch. The preferred mesh number is 30 meshes per inch which allows fiber waste collected on either surface to be withdrawn by the filter cleaner 10 operating along the first surface 8*a***. Wire nets or similar filter substitutes with comparable perforations may be employed in accordance with this invention.

Figure 3:
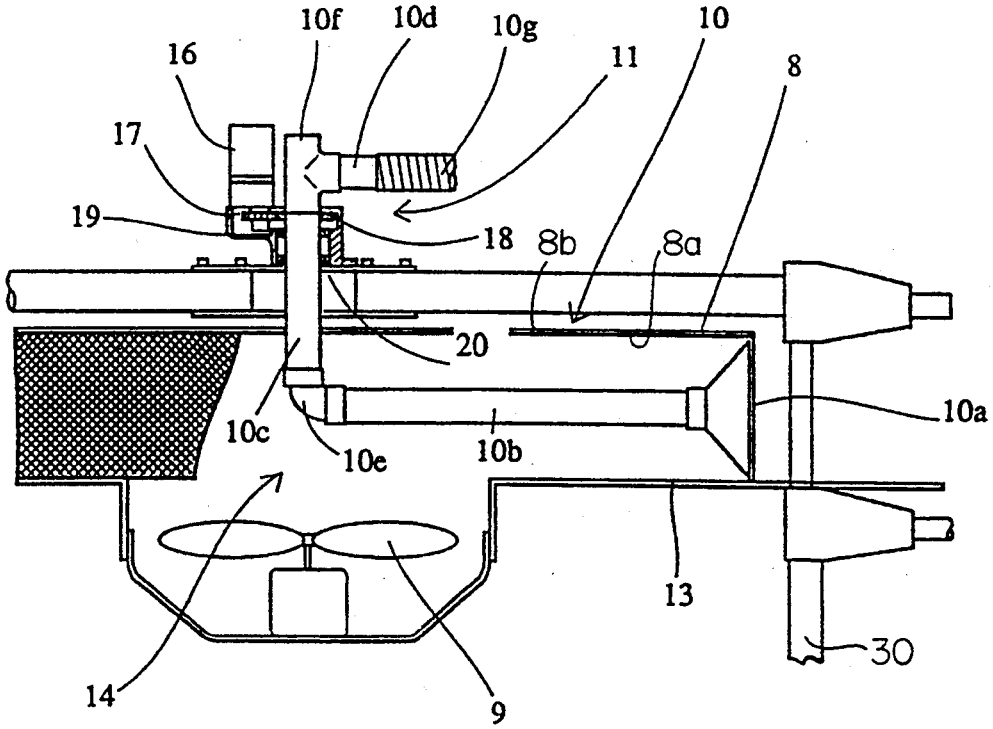
FIG. 3 is a partial sectional view of fiber waste collection and remover in accordance with the present invention.

In the embodiment shown on FIG. 3, the filter 8 is fixed along its bottom portion to a circular bottom plate 13 which projects radially outward toward the upper portion of a yarn carrier 12 (shown in FIG. 1). The bottom plate 13 has a cup-shaped area which forms a center region 14. The center region 14 provides sufficient room for the air suction/blowing means 9, which in this embodiment is a motor fan, to be supported and centrally located above the knitting unit 3. The bottom plate 13, the filter 8 and the filter cleaner 10 are positioned above the knitting unit 3 by vertically extending posts 30 positioned on the frame 2 (as shown in FIG. 1).

Still referring to FIG. 3, the filter cleaner 10 includes a tip opening **10*a* which has a flared head sized to correspond to the width of the first surface 8*a* of the filter 8 so that one rotation of either the filter cleaner 10 or the filter 8 relative to each other cleans the entire filter. The tip opening 10*a* is attached at one end to a first horizontal portion 10*b* extending horizontally toward the center region 14. A vertical portion 10*c* extends vertically upward from the fan motor 9 generally transverse to the first horizontal portion 10*b*. An elbow portion 10*e* joins the first horizontal portion 10*b* and the vertical portion 10*c*. A T-shaped portion 10*f* extends vertically upward from vertical portion 10*e* such that second horizontal portion 10*d* is attached thereto and is located in parallel alignment above first horizontal portion 10*b*. In this embodiment, portions 10*a*, 10*b*, 10*c*, and 10*e* form an integral unit which is rotatably driven by driving means 11, enabling the filter cleaner to rotate around vertical portion 10*c* to clean along the first surface 8*a* of the filter 8. It is to be understood that in an alternative embodiment shown in FIG. 5, (described below in greater detail), the filter cleaner 10' remains stationary while the drive means 11' rotates the filter 8'** relative thereto.

The drive means 11 includes a first spur gear 17 mounted on a shaft end of a gear motor 16. A second spur gear be is mounted on the periphery of the vertical portion **10*c* of the cleaning filter 10. A motor stand 19 surrounds the spur gears 17 and 18 and provides support for a center member 20 on which the gear motor 16 is mounted. This arrangement of the gear motor 16 allows the gear motor 16 to revolve at a slow speed, with the interval of operation predetermined by a timer (not shown). When activated, the gear motor 16 revolves the filter cleaner 10 around the inside of the filter 8 along the first surface 8*a* thereof to remove fiber waste collected on the first surface 8*a* of the filter 8**.

Figure 4:
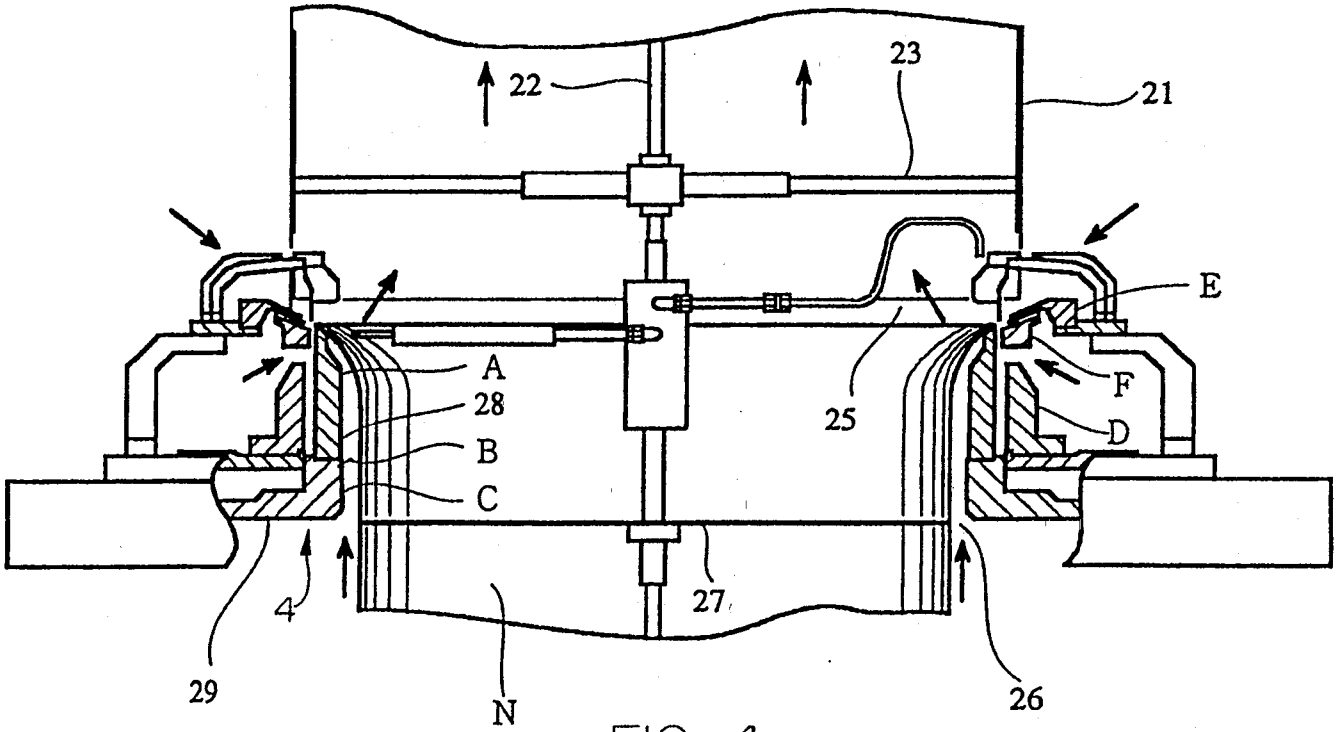
FIG. 4 is an enlarged view of the knitting unit and the cooling device of the present invention.

An adjustable suction cylinder 21 is located below the motor fan 9. The suction cylinder 21, of the embodiment shown in FIGS. 1 and 4, is constructed of transparent plastic material that is vertically divided into several sections or pieces. The pieces are concentrically arranged to allow slidable vertical adjustment relative to one another. The suction cylinder 21 is located between the motor fan 9 and the knitting unit 3. The suction cylinder 21 has an external diameter at least equal to the external diameter of the knitting unit.

In this embodiment, the suction cylinder 21 is supported in position by a center shaft 22 extending vertically between the fan motor 9 and the frame 2. Radial supports 23 attached to the center shaft 22 and extending radially horizontally outward therefrom assist in supporting the suction cylinder 21 (see FIG. 4). Between the upper portion of the suction cylinder 21 and the motor fan 9 is an upper gap 24 (shown in FIG. 1). A lower gap 25 is located between the lower portion of the suction cylinder 21 and the needle cylinder 4. To ensure that an optimum vacuum is formed by the suction cylinder 21, while still allowing ambient air to flow into the suction cylinder 21, it is important to position the suction cylinder 21 as close to the needle cylinder 4 as possible, making the lower gap 25 as small as possible. The ability to vertically adjust the suction cylinder 21 by vertical movement of the concentrically arranged divided sections of the suction cylinder 21, relative to one another, allows for the adjustment of the size of the upper gap 24 and the lower gap 25 which in turn adjusts the amount of air intake in each of the gaps 24 and 25. This ability to vertically adjust the suction cylinder 21 has a further advantage of enabling easy repair to the knitting unit 3 and its related components without requiring disassembly of the suction cylinder 21.

As best shown in FIG. 4, an orifice disk 27 is mounted on the center shaft 22 in horizontal alignment with the bottom of the base portion 29 of the needle cylinder 4. The orifice disk 27 has a dual purpose. One purpose is to take the circular knit fabric N, which is cylindrical as it leaves the knitting unit 3, and spread or stretch it so that the knit fabric N can be wound flat on a take-up roll (not shown) located beneath the knitting unit 3. To assist in this function, the orifice disk 27 of this embodiment has a circular shape. It is to be understood that other shapes may also be utilized and remain within the spirit of the invention.

A second purpose of orifice disk 27 is to define a cooling orifice 26 located between the needle cylinder 4 of the knitting unit 3 and the fabric N. The cooling orifice 26 is a channel that runs the height of the needle cylinder 4, which has a cylinder portion 28 and a base portion 29 which supports the cylinder portion 28. The cooling orifice 26 cross section decreases as it approaches the knitting unit which causes the air passing therethrough to speed up to cool the hitting unit 3. In this embodiment, the preferred cross section of the cooling orifice 26 is between 2–5 cm. Increasing the air speed passing through the cooling orifice 26 improves the cooling effect of the air.

In operation, the fan motor 9 draws air from beneath the knitting unit 3 in the direction of the arrows which appear on FIGS. 1 and 4, as a result of the suction or vacuum created by the suction cylinder 21. Because of the cross sectional size of the cooling orifice 26, the air is forced to speed up, which improves its cooling effect, as it travels over the needles (not shown) on the needle cylinder 4, the sinkers 6 and the other moving parts of the knitting unit 3.

An experiment was conducted to compare how the temperature varied between the machines with and without an orifice and a suction cylinder. The comparison was done by measuring various parts, labeled A through F in FIG. 4 (which correspond to the temperatures appearing in the table below) after running the machines unloaded for 1,200 hours at a room temperature of 26° C. The results of the experiment are summarized in the table below.

| Location of Temperature Measurement | Prior Art (without a cooling orifice or a suction cylinder) | Invention (with a cooling orifice and a suction cylinder) | Temperature Difference |
|---|---|---|---|
| A | 73.4 C. | 65.2 C. | 8.2 C. |
| B | 66.7 C. | 61.9 C. | 4.8 C. |
| C | 61.4 C. | 54.9 C. | 6.5 C. |
| D | 65.4 C. | 59.1 C. | 6.3 C. |
| E | 57.2 C. | 40.4 C. | 16.8 C. |
| F | 72.8 C. | 52.0 C. | 20.8 C. |

As is evident from the results shown in the table, the inclusion of a cooling orifice and an adjustable suction cylinder in the present invention has significantly reduced the operating temperature of the knitting unit.

Continuing with the operation of the invention, the fiber waste which is generated by the knitting process at the knitting unit 3 is driven upward by cooperation between the motor fan 9 and the suction cylinder 21. The fiber waste is conducted upward into the suction cylinder 21 (as shown by the arrows in FIGS. 1 and 4), and then into the filter 8. The fiber waste is trapped and collected along the first surface 8*a* of the filter 8. The filter cleaner 10 is periodically activated by a timer (not shown) which activates the gear motor 16. The gear motor 16 rotates the integral portion of the filter cleaner 10 (elements 10*a*, 10*b*, 10*c*, and 10*e*) so that the tip opening 10*a* travels along the first surface 8*a* of the filter 8 to remove the fiber waste which has collected thereon since the previous pass-by of the tip opening 10*a*. The fiber waste then travels through the remaining portions of the filter cleaner 10 until it reaches a flexible tube 10*g*. The fiber waste travels through the flexible tube 10*g* to a suction device 15 where the fiber waste is stored until it is disposed of as desired.

Figure 5:
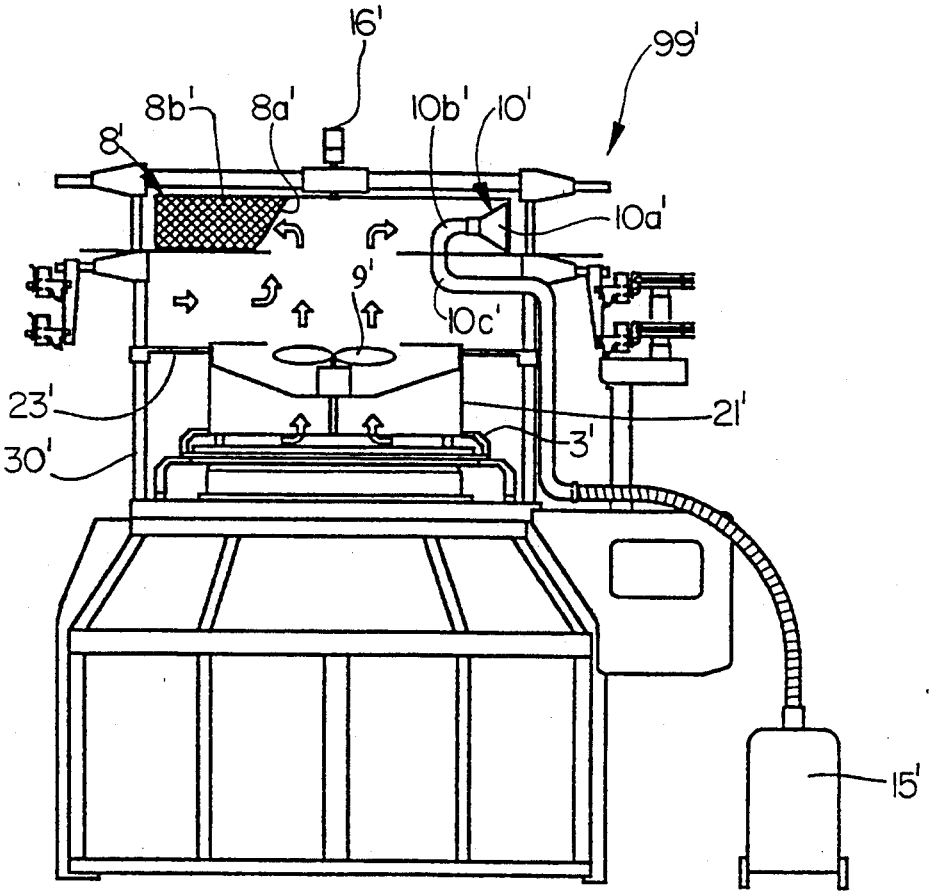
FIG. 5 is a front elevational view of an alternative embodiment of the present invention.

FIG. 5 illustrates an alternative embodiment of the present invention. In this embodiment, the invention operates in a manner similar to that described with regard to FIGS. 1–4, except that rather than having a filter cleaner 10 rotate relative to a fixed filter 8, in this embodiment the filter 8' rotates relative to a fixed filter cleaner 10'. As is clearly shown in FIG. 5, the vertical portion 10*c'* of the filter cleaner 10' extends downward from the first horizontal portion 10*b'* rather than upward therefrom. In this embodiment the vertical portion 10*c'* and the first horizontal portion 10*b'* may be constructed of a single C-shaped piece and remain within the spirit of the invention. This new arrangement of the filter cleaner 10' allows the filter cleaner to remain stationary. The gear motor 16' in this embodiment is attached to the filter 10' in much the same manner as the filter cleaner 10 of the previous embodiment. The gear motor 16' rotates at a slow rate to revolve the filter 8' relative to the fixed filter cleaner 10' so that the first surface 8*a'* of the filter 8' passes in front of the tip opening 10*a'* to remove fiber waste from the filter 8'. An additional difference between the first embodiment shown in FIGS. 1–4 and the present embodiment illustrated in FIG. 5 is the location of the fan motor 9'. In this embodiment, the fan motor 9' is positioned farther from the filter 8' than before. The fan motor 9' is supported by the radial supports 23' attached to vertical extending posts 30' and the fan motor 9' is located closer to the knitting unit 3' of the circular knitting machines 99'. In all other respects, the embodiment shown in FIG. 5 functions in the same manner as previously described.

Figure 6:
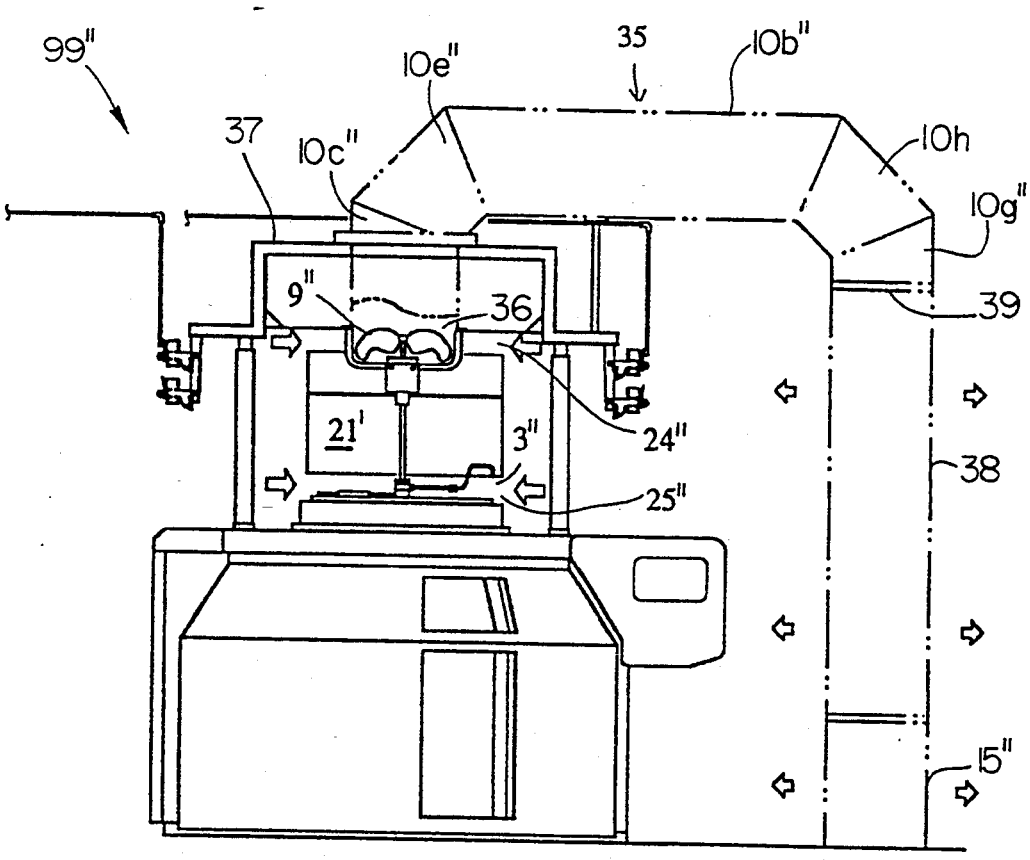
FIG. 6 is a front elevational view of another alternative embodiment of the present invention.
Figure 7:
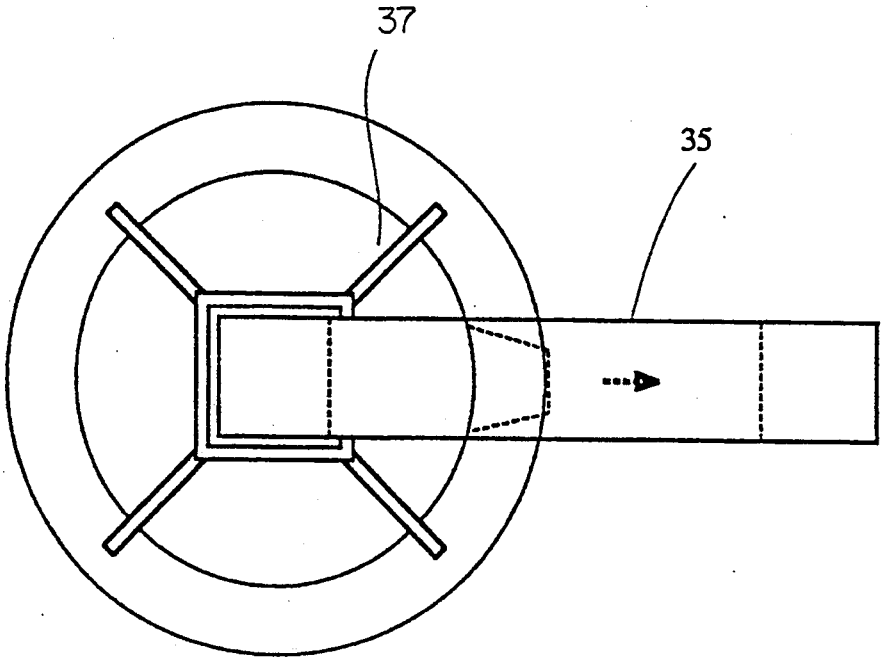
FIG. 7 is a top plan view of the alternative embodiment shown in FIG. 6.

FIGS. 6 and 7 illustrate a third embodiment of the present invention. In FIGS. 6 and 7, rather than utilizing a flexible tube 10*g* to remove the fiber waste from the knitting machine 99, a series of ducts 35 are utilized to remove the fiber waste and transport it to the suction device 15''.

In this embodiment, the ducts 35 are of rigid construction, however, it is to be understood that a more flexible construction may be utilized and still remain within the spirit of the invention. The duct 35 has a first vertical portion 10*c''* which extends upward from the motor fan 9''. The first vertical portion 10*c''* has a suction opening 36. The suction opening 36 is supported by a frame 37. The fan motor 9'' is in turn supported by the suction opening 36. A first horizontal portion 10*b''* extends radially outward from the knitting machine 99''. A first elbow portion 10*e''* joins the first vertical portion 10*c''* and the first horizontal portion 10*b''*. A second vertical portion 10*g''* extends downward from the first horizontal portion 10*b''* in generally parallel alignment with the knitting machine 99''. A fiber waste-collection net 38 is located between the second vertical portion 10*g''* and the suction device 15''. A second elbow portion 10*h* joins the first horizontal portion 10*b''* and the second vertical portion 10*g''*. An exhaust opening 39 is located in the second vertical portion 10*g''* for allowing some of the air to exhaust to atmosphere. An acceptable alternative to the embodiment shown in FIG. 6 is to locate or mount the motor fan 9'' within the first horizontal portion 10*b''* or on the bottom of exhaust opening 39. Movement of the motor fan in either of these locations will not affect the function or performance of the motor fan 9''.

Many modifications and other embodiments of the invention will come to mind of one skilled in the art of the present invention having the benefit of the teachings presented in the foregoing descriptions and the associated drawings. Therefore, it is to be understood that the invention is not to be limited to the specific embodiments which have been disclosed, and that modifications and embodiments are intended to be included within the scope of the appended claims.

That which is claimed:

1. In a circular knitting machine including a knitting unit having a rotating needle cylinder and knitting elements carried by the needle cylinder for knitting fabric from yarns supplied thereto, the combination therewith of apparatus for removing and collecting fiber waste while cooling the knitting unit, said apparatus comprising:

a filter located above said needle cylinder for collecting fiber waste;

filter cleaning means attached to said filter for removing fiber waste therefrom;

air suction/blowing means located above the knitting unit for generating and directing an air flow;

positioning means located closely adjacent said needle cylinder below said knitting elements for positioning the knit fabric relative to the needle cylinder for defining a cooling orifice therebetween; and a suction cylinder located between the needle cylinder and said air suction/blowing means and creating therewith a vacuum for drawing fiber waste laden air through said suction cylinder into said filter and for drawing air through said cooling orifice for cooling the knitting unit.

2. An apparatus according to claim 1 wherein said positioning means comprises:

a substantially circular orifice disk of lesser diameter than said needle cylinder for stretching and supporting the knit fabric.

3. An apparatus according to claim 1 wherein said cooling orifice comprises a channel having a cross section which narrows as it approaches the knitting unit, thereby causing air to speed up as it passes therethrough for cooling the knitting unit.

4. An apparatus according to claim 1 further comprising:

a center shaft vertically extending at least between said air suction/blowing means and the knitting unit for supporting said suction cylinder; and a plurality of radial supports extending radially outward from said center shaft for supporting said suction cylinder.

5. An apparatus according to claim 1 wherein said suction cylinder comprises:

a plurality of divided sections concentrically arranged wherein at least one of said divided sections is vertically slidable relative to another of said plurality of divided sections for selective vertical adjustment thereof.

6. An apparatus according to claim 1 wherein said suction cylinder is generally centrally located over the knitting unit.

7. An apparatus according to claim 1 wherein said suction cylinder has an outer diameter generally equal to an outer diameter of the knitting unit.

8. In a circular knitting machine including a knitting unit having a rotating needle cylinder and knitting elements carried by the needle cylinder for knitting fabric from yarns supplied thereto, the combination therewith of apparatus for removing and collecting fiber waste while cooling the knitting unit, said apparatus comprising:

a filter located above said needle cylinder for collecting fiber waste;

filter cleaning means attached to said filter for removing fiber waste therefrom;

air suction/blowing means located above the knitting unit for generating an air flow and for directing fiber waste laden air into said filter;

positioning means located below said knitting elements and closely adjacent said needle cylinder for positioning the knit fabric relative to the needle cylinder for defining a cooling orifice therebetween; and an adjustable suction cylinder having a plurality of divided, concentrically arranged sections for vertical adjustment thereof, said suction cylinder being located between the needle cylinder and said air suction/blowing means and creating therewith a vacuum for drawing fiber waste laden air into said filter and for drawing air through said cooling orifice for cooling the knitting unit.

9. An apparatus according to claim 8 wherein said positioning comprises:

a substantially circular orifice disk for stretching and supporting the knit fabric.

10. An apparatus according to claim 8 wherein said cooling orifice comprises a channel having a cross section which narrows as it approaches the knitting unit, causing air to speed up as it passes therethrough for cooling the knitting unit.

11. An apparatus according to claim 8 further comprising:

a center shaft vertically extending at least between said air suction/blowing means and the knitting unit for supporting said suction cylinder; and a plurality of radial supports extending radially outward from said center shaft for supporting said suction cylinder.

12. An apparatus according to claim 8 wherein said suction cylinder is generally centrally located over the knitting unit.

13. An apparatus according to claim 8 wherein said suction cylinder has an outer diameter generally equal to an outer diameter of the knitting unit.

* * * * *